US005967511A

United States Patent [19]

Bell

[11] Patent Number: 5,967,511

[45] Date of Patent: Oct. 19, 1999

[54] SHEET REGISTRATION ASSEMBLY INCLUDING A FORCE REDUCING DESKEW ROLL

[75] Inventor: Conrad John Bell, Webster, N.Y.

[73] Assignee: Xerox Corporation, Stamford, Conn.

[21] Appl. No.: 08/819,187

[22] Filed: Mar. 17, 1997

[51] Int. Cl.[6] ..... B65H 9/16

[52] U.S. Cl. ..... 271/252; 271/250; 271/251

[58] Field of Search ..... 271/250, 251, 271/252

[56] References Cited

U.S. PATENT DOCUMENTS

| | | | |
|---|---|---|---|
| 4,621,801 | 11/1986 | Sanchez | 271/251 |
| 4,836,527 | 6/1989 | Wong | 271/251 |
| 5,065,998 | 11/1991 | Salomon | 271/251 |

FOREIGN PATENT DOCUMENTS

| | | |
|---|---|---|
| 0 127 479 A1 | 5/1984 | European Pat. Off. . |
| 0 386 278 A1 | 12/1990 | European Pat. Off. . |
| WO 93/02956 | 2/1993 | WIPO . |

*Primary Examiner*—Donald P. Walsh
*Assistant Examiner*—Brett C. Martin
*Attorney, Agent, or Firm*—Tallam I. Nguti

[57] ABSTRACT

A sheet registration and deskew assembly including a force reducing deskew roll having deflectable ribs, and alternating grooves for enabling the ribs to deflect once the sheet is in resisting contact against a registration edge guide member of the registration assembly, thus reducing a driving force on the sheet, and hence preventing damage to the sheet as well as excessive wear on the registration edge guide member.

6 Claims, 4 Drawing Sheets

SHEET REGISTRATION ASSEMBLY INCLUDING A FORCE REDUCING DESKEW ROLL

The present invention relates generally to electrostatographic reproduction machines, and more particularly to a sheet registration assembly in such a machine including a drive force reducing sheet deskew roll for preventing damage to sheets being deskewed or aligned for registration.

Generally, the process of electrostatographic production or reproduction of an image on a sheet of material is initiated by exposing a light image of an original image document onto a substantially uniformly charged photoreceptive member. The original image document may be manually placed, in registration, at an exposure station for such exposure, or it may be fed automatically by an automatic document handling device, also in registration, to the exposure station. Exposing the light image onto the charged photoreceptive member discharges areas of a photoconductive surface thereof corresponding to non-image areas in the original document, while maintaining the charge in image areas, thereby creating an electrostatic latent image of the image of the original document on the photoreceptive member.

Thereafter, developing material including charged toner particles is deposited onto the photoreceptive member such that the charged toner particles are attracted to the image areas on the photoconductive surface to develop the electrostatic latent image into a visible image. This developed image is then transferred from the photoreceptive member, either directly or after an intermediate transfer step, to an image receiving support substrate, such as a copy sheet of paper, thus creating a toner image on the support substrate corresponding to the original image of the original document. The image receiving support substrate, such as a copy sheet of paper, typically is fed automatically from a supply source, and in timed registration, to an image transfer station for receiving the toner image as such. Subsequently, the transferred image is typically fused and affixed to the image support substrate to form a permanent image thereon. In a final step, the photoconductive surface of the photoreceptive member is cleaned to remove any residual developing material thereon in preparation for successive imaging cycles.

Sheet handling devices are commonly used in printing systems, and particularly in electrostatographic reproduction machines of the type described hereinabove, for transporting and registering document and copy substrate sheets to predetermined locations required for accomplishing the printing process. Such sheet handling devices are generally referred to in two categories: document handlers, which are used to transport image bearing sheets; and copy substrate sheet handlers, which transport blank page sheets of material for receiving toner images. Printers, duplicators and copiers commonly employ both types of sheet handling devices to transport sheets to and from an image reproduction or imaging subsystem. As pointed out above, such subsystems or stations include the exposure or image input scanning station, and the toner image transfer station. Image input devices which include scanners, optical character readers and the like, also employ sheet handling devices of the type to which this invention relates.

In systems employing such sheet handling devices, maintaining proper alignment of the image support sheet along the transport path thereof so as to inhibit skew or misalignment of the sheet being transported is an important function required to provide acceptable performance. For example, it is important to deskew or inhibit skew in a transported document sheet in a typical electrostatographic reproduction machine employing an automatic document handler device. In such machines, the automatic document handler device automatically transports or feeds a document sheet from a stack thereof to a registered position at the exposure station. As such, it is important to deskew or inhibit skew in the transported document sheet so as to provide proper registration of the image on the document sheet to an imaging frame of the photoconductive member which is then at a fixed position at the exposure station.

Similarly, it is important, in a copy sheet handling device of the machine, to deskew or inhibit the skew of a transported copy sheet, during image transfer, in order to provide proper registration of the copy sheet to the toner image on the photoconductive member. Such registration at the transfer station produces or results in an acceptably high quality output image on the copy sheet that is properly centered and aligned.

Failure to properly control skewing and registration of input documents in a document handler, or in copy sheets being handled by a copy sheet handling device, will result in the image produced being misaligned relative to the edges of the copy sheet, and hence being of poor quality. In addition, failure to properly deskew a document or copy sheet can cause jams and other similar paper transport problems. Thus, in sheet transport devices, such as document feeders and automatic or semiautomatic document handlers, as well as in copy sheet transport devices, proper control of skew and registration of sheets being handled, are important and essential system requirements.

Many devices and techniques have been developed and utilized in attempts to provide proper deskew and registration of sheets as called for above. One simple solution is the placement of side or lateral registration edges in the loading areas of the sheets to be fed. In addition, active registering devices, such as scuffer rolls, cross-rolls and the like have been used to achieve relatively satisfactory results. In most cases, sheets are transported in the general proximity of a fixed edge member or so-called registration edge guide, with the active registering device forcing the sheet against the registration edge guide in order to provide alignment of the sheet with the guide's edge. Examples of such devices are disclosed in U.S. Pat. Nos. 4,621,801; 4,836,527; and 5,065,998, among others.

However, it has been found that in systems which are intended to deskew and register sheets, one at a time, against a lateral registration edge of a guide member, excessive wear of the registration edge guide, as well as damage to edges of the sheet being registered, often occur. Indeed, in a typical machine, the registration edge guide is provided in the form of a molded plastic, or other suitable material, element, wherein paper, which may represent a highly abrasive material when moving at high speeds, can cause a groove to be cut into the plastic or abrasion resistant material registration edge guide. This causes damage and or transport restriction to the edge of the sheets, and may induce misregistration of sheets, as well as, sheet jams and resultant machine failures.

This problem can be exacerbated by the use of heavier weight sheets such as label bearing sheets, as well as, vellum materials and the like, because increased drive forces are typically generated on the heavier sheets by the active registration devices. For example, in the case of conventional deskew or cross rolls, the normal force imparted on the copy sheet in the nip tends to increase and is required as the sheets become thicker. As a result, the drag or frictional force generated by the heavier weight sheets along the lateral registration edge guide also tends to be greater, thus causing damage both to the edge guide and sheet itself. Some efforts to solve this problem have included reducing pinch-feed roll nominal force, and possibly reducing the angle of attack in deskew or cross roll arrangements. These efforts, however, instead tend to reduce the efficiency of the design, which ordinarily is intended to handle many different weights of sheets, including 20-lb. paper as the most common.

SUMMARY OF THE INVENTION

In accordance with one aspect of the present invention, there is provided a sheet registration assembly including a force reducing deskew roll having non-axial deflectable ribs, and alternating grooves for enabling the ribs to deflect once the sheet is in resisting contact against a registration edge guide member of the registration assembly, thus reducing a driving force on the sheet, and hence preventing damage to the sheet as well as excessive wear on the registration edge guide member.

In accordance with another aspect of the present invention, there is provided an apparatus for deskewing and registering a sheet material moving along a process direction of travel, comprising: a registration edge guide member defining a surface substantially parallel to the process direction of travel; and at least a ribbed compliant deskew roll for driving the sheet material laterally relative to the process direction of travel so as to urge the sheet material against the registration edge guide member thus providing proper alignment and registration of the sheet material. The ribbed deskew roll includes non-axial deflectable ribs and grooves that deflect for reducing a driving force of the roll on the sheet once the sheet is in resisting contact against the registration edge guide member, thus eliminating damage to the sheet, and excessive wear on the registration edge guide member.

BRIEF DESCRIPTION OF THE DRAWINGS

Other aspects of the present invention will become apparent as the following description proceeds and upon reference to the drawings, wherein like reference numerals have been used throughout to identify identical or similar elements, and in which.

DETAILED DESCRIPTION OF THE INVENTION

While the present invention will hereinafter be described in connection with a preferred embodiment, it will be understood that this description is not intended to limit the invention to that embodiment or method of use. On the contrary, the following description is intended to cover all alternatives, modifications, and equivalents, as may be included within the spirit and scope of the invention as defined by the appended claims.

Figure 1:
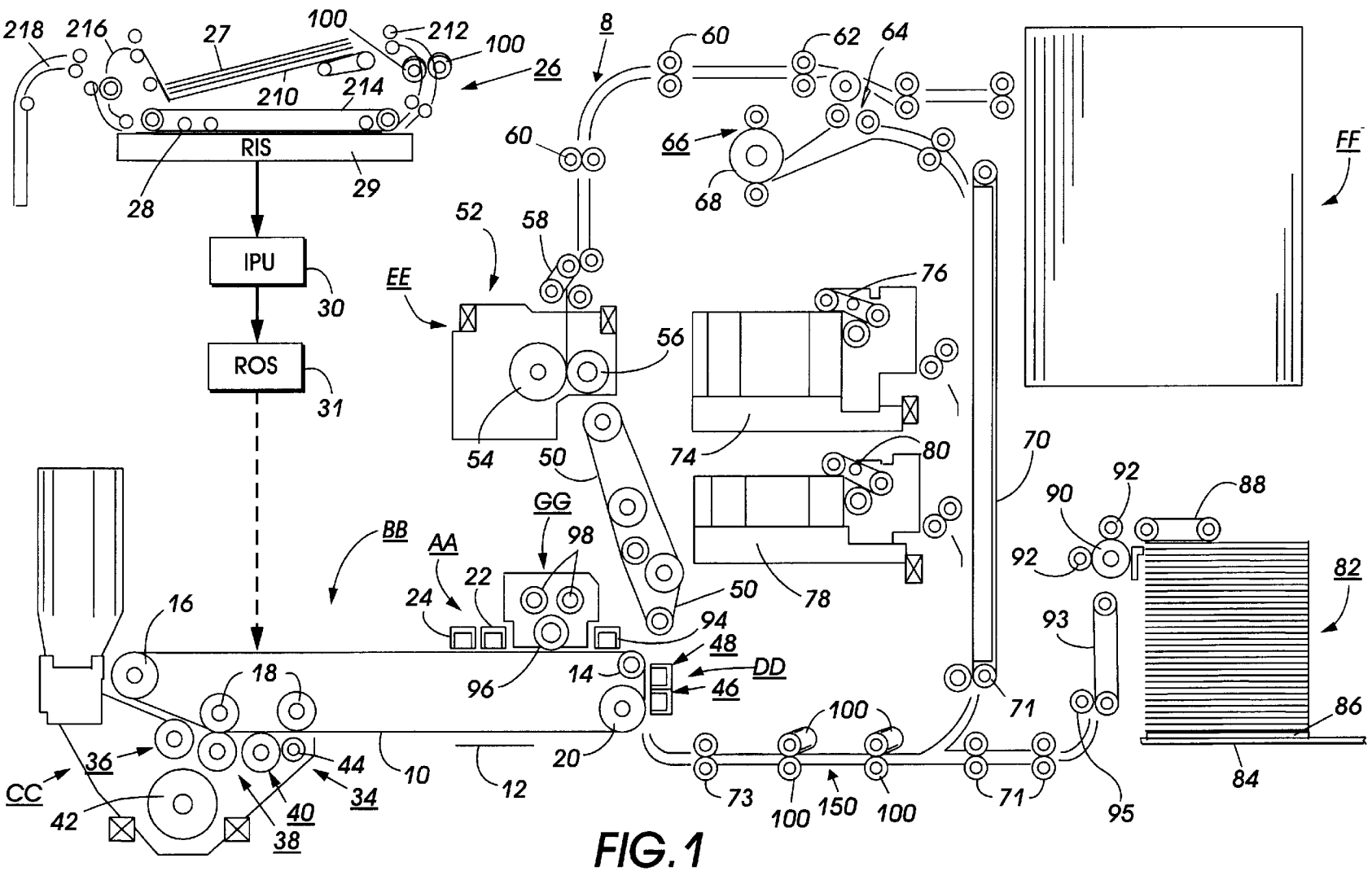
FIG. 1 is a schematic elevational view depicting an illustrative electrostatographic reproduction machine incorporating sheet registration assemblies including driving force reducing sheet deskew rolls in accordance with the present invention.

Referring initially to FIG. 1, a schematic depiction of an exemplary electrostatographic reproducing machine incorporating various machine systems is furnished in order to provide a general background and understanding of the features of the present invention. Although the apparatus of the present invention is particularly well adapted for use in an automatic electrostatographic reproduction machine 8 as shown in FIG. 1, it will become apparent from the following discussion that the registration assembly and drive force reducing deskew roll of the present invention are equally well suited for use in a wide variety of electrostatographic processing machines, and in many other known printing systems.

The exemplary electrostatographic reproduction machine 8 of FIG. 1 employs a photoconductive belt 10, preferably comprising a photoconductive material coated on a ground layer, which, in turn, is coated on an anti-curl substrate. Belt 10 is entrained about stripping roll 14, tensioning roll 16, rolls 18, and drive roll 20. Stripping roll 14 and rolls 18 are mounted rotatably so as to rotate with belt 10. Tensioning roll 16 is resiliently urged against belt 10 to maintain belt 10 under a desired tension. Drive roll 20 is rotated by a motor (not shown) coupled thereto by any suitable means such as a drive belt. Thus, as roll 20 rotates, it advances belt 10 in the direction of arrow 12 to advance successive portions of the photoconductive surface sequentially through various electrostatographic processing stations disposed about the path of movement thereof.

Initially, a portion of photoconductive belt 10 passes through charging station AA where two corona generating devices, indicated generally by the reference numerals 22 and 24 charge a surface of the photoconductive belt 10 to a relatively high, and substantially uniform potential. This dual or "split" charging system is designed so that corona generating device 22 places all of the required charge on photoconductive belt 10 while corona generating device 24 acts as a leveling device to provide a uniform charge across the surface of the belt. Corona generating device 24 also fills in any areas missed by corona generating device 22.

Next, the charged portion of photoconductive belt 10 is advanced through imaging station BB. At imaging station BB, a document handling unit or handler, indicated generally by reference numeral 26 and including force reducing deskew rolls 100 of the present invention (to be described in detail below), is positioned over platen 28 of the reproduction machine 8. The document handling unit 26 sequentially feeds documents from a stack 27 of original document sheets placed in a document stacking and holding tray 210 as shown, such that the original document sheets containing images to be copied are loaded, for example, face up in the document tray. As is well known, the document handling unit 26, although shown as a bottom feeder, can also be a top feeder. In either case, a bottom or top sheet respectively is fed seriatim from the stack to rolls 212 for advancing in registration onto platen 28 by means of a belt transport 214. As shown, the belt transport 214 is moved over the platen 28 with the original document sheet being interposed between the platen and the belt transport.

When the original document sheet is properly positioned and registered on platen 28, the document is imaged and the original document is returned to the document tray from platen 28 by either of two paths. If only a simplex copy of the document sheet image is being made or if this is the first pass of a two pass duplex copying process, the original document sheet is returned to the document tray 210 via only a simplex path 216. If the document sheet is to be imaged on a second pass of a two pass duplex copying process, then the original document sheet is instead first moved through a duplex path 218, reimaged, and then returned to the document tray through simplex path 216.

Imaging of the document is achieved by a scanning assembly, preferably comprising a Raster Input Scanner (RIS) 29 for capturing the entire image from the input document and converting the image into a series of raster scan lines corresponding to individual picture elements or so-called pixels making up the original input document. The output signal of the RIS 29 is transmitted as an electrical signal to an Image Processing Unit (IPU) 30 where they are converted into an individual bitmap representing the receptive values of exposure for each pixel. The IPU 30 can store bitmap information for subsequent imaging or can operate in a real time mode. The digital output signal generated by the IPU 30 is transmitted to a Raster Output Scanner (ROS) 31 for writing the image bitmap information onto the charged surface of the photoreceptive belt 10 by selectively erasing charges thereon in a pixel-by-pixel manner.

It should be noted that either a discharged area development (DAD) approach in which discharged portions are developed can be employed, or a charged area development (CAD) approach in which charged areas are developed can be employed, as known in the art. This process records an electrostatic latent image on photoconductive belt 10 corresponding to the informational areas contained within the original document. Thereafter, photoconductive belt 10 advances the electrostatic latent image recorded thereon to development station CC.

At development station CC, a magnetic brush developer housing, indicated generally by the reference numeral 34, is provided, having three developer rolls, indicated generally by the reference numerals 36, 38 and 40. A paddle wheel 42 picks up developer material in the developer housing and delivers the developing material to the developer rolls. When the developer material reaches rolls 36 and 38, it is magnetically split between the rolls with approximately half of the developer material being delivered to each roll. Photoconductive belt 10 is partially wrapped about rolls 36 and 38 to form an extended development zone or nip about each roll.

Developer roll 40 is a cleanup roll and magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station DD.

At transfer station DD, a copy sheet (not shown) is moved in timed registration, into contact with the toner powder image on belt 10. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray 84 to transfer station DD, via a copy sheet handling system including a vacuum feed belt 88 that feeds successive uppermost sheets from the stack to a take away roll 90, and rolls 92. The take-away roll 90 and rolls 92 guide the sheet to a vertical transport 93. Vertical transport 93 and roll 95 advance the sheet to rolls 71 which, in turn, move the sheet through a registration assembly 150 including force reducing deskew rolls 100 of the present invention (to be described in detail below), and toward the toner image transfer station DD.

As shown, copy sheets may also be fed to transfer station DD from a secondary tray 74 or from an auxiliary tray 78, which each includes an elevator driven by a bidirectional AC motor and a control having the ability to drive the tray up or down. When the tray is in the down position, stacks of copy sheets are loaded thereon or unloaded therefrom. In the up position, successive copy sheets may be fed therefrom by a sheet feeder 76 or 80 that includes a friction retard feeder utilizing a feed belt and take-away rolls to advance successive copy sheets to transport 70.

As previously discussed, it is important that proper alignment of the copy sheet is maintained along a transport path of the copy sheet handling system thereof so as to inhibit skew, and so as to provide proper alignment and registration of sheets transported through the transfer station. Preventing skew and proper registration are necessary for producing an output copy sheet on which the image imparted thereto is properly centered and aligned. Failure to provide proper registration of a copy sheet will generally result in unacceptable image transfer to the copy sheet. Unacceptable images include images that are not in alignment with the copy sheet edge (so-called skewed images), images extending off of the edge of the sheet, and images containing other misimaging problems. Failure to provide deskew and proper registration can also result in paper jams and other substrate misfeed failures. In response to this problem, a pair of deskew rolls or similar active registration devices, indicated schematically by reference numeral 100, are provided in the copy sheet registration assembly 150 as shown.

Still referring to FIG. 1, at the transfer station DD, the developed or toner image on belt 10 contacts the properly registered advancing copy sheet in timed registration, and is transferred thereonto. As can be seen in the illustrated embodiment, a corona generating device 46 charges the copy sheet to a proper potential so that the sheet is electrostatically secured or "tacked" to belt 10 and the toner image thereon is attracted to the copy sheet. After image transfer, a second corona generator 48 charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting to fusing station EE.

Fusing station EE includes a fuser assembly, indicated generally by the reference numeral 52, which fuses and permanently affixes the transferred toner image to the copy sheet. Preferably, fuser assembly 52 includes a heated fuser roll 54 and a pressure roll 56 with the powder image on the copy sheet contacting fuser roll 54. The pressure roll 56 abuts the fuser roll 54 to provide the necessary pressure to fix the toner powder image to the copy sheet. In this fuser assembly, the fuser roll 54 is internally heated by a quartz lamp while a release agent, stored in a reservoir, is pumped to a metering roll which eventually applies the release agent to the fuser roll.

After fusing, the copy sheets are fed through a decurling apparatus 58 which bends the copy sheet in one direction to put a known curl in the copy sheet, thereafter bending the copy sheet in the opposite direction to remove that curl, as well as any other curls or wrinkles which may have been introduced into the copy sheet. The copy sheet is then advanced, via forwarding roll pairs 60 to duplex turn roll 62. A duplex solenoid gate 64 selectively guides the copy sheet to finishing station FF or to inverter 66. In the finishing station, the copy sheets are collected in sets and the copy sheets of each set can be stapled or glued together. Alternatively, duplex solenoid gate 64 diverts the sheet into inverter 66, providing intermediate storage for one sheet which has been printed on one side and on which an image will be subsequently printed on the second, opposed side thereof, i.e. the sheet being duplexed. In order to complete duplex copying, the simplex sheet in inverter 66 is fed by a feed roll 68 from inverter 66 back to transfer station DD for transfer of the toner powder image to the opposite side of the copy sheet.

Invariably, after the copy sheet has been separated from photoconductive belt 10 subsequent to image transfer therefrom, some residual particles remain attached to the surface of the belt 10. As a result, photoconductive belt 10 passes beneath yet another corona generating device 94 which charges the residual toner particles to the proper polarity for breaking the bond between the toner particles and the belt. Thereafter, a pre-charge erase lamp (not shown), located inside the loop formed by photoconductive belt 10, discharges the photoconductive belt in preparation for the next charging cycle. Residual particles are removed from the photoconductive surface at cleaning station GG. Cleaning station GG includes an electrically biased cleaner brush 96 and two waste and reclaim de-toning rolls 98. One reclaim roll 98 is electrically biased negatively relative to the cleaner roll 96 so as to remove toner particles therefrom while the other reclaim roll 98 is electrically biased positively relative to the cleaner roll 96 so as to remove paper debris and wrong sign toner particles. The toner particles on the reclaim roll 98 are scraped off and deposited in a reclaim auger (not shown), where they are transported out of the rear of cleaning station GG.

The various machine subsystems described hereinabove are typically regulated by an electronic subsystem (ESS) (not shown) which is preferably a control such as a programmable microprocessor capable of managing all of the machine functions. Among other things, the control provides a comparison count of the copy sheets, the number of documents being recirculated, the number of copy sheets selected by the operator, time delays, jam indications and subsystem actuation signals. Conventional sheet path sensors or switches may be utilized to keep track of the position of documents and the sheets in the machine. In addition, the control regulates the various positions of gates and switching depending upon the mode of operation selected.

The foregoing description should be sufficient for the purposes of the present application for patent to illustrate the general operation of an electrostatographic printing apparatus incorporating the features of the present invention. As previously discussed, the electrostatographic reproducing apparatus may take the form of any of several well known systems including various printing and copying machines manufactured by Xerox Corporation. Variations of specific electrostatographic processing subsystems or processes may be expected without affecting the operation of the present invention.

Figure 2:
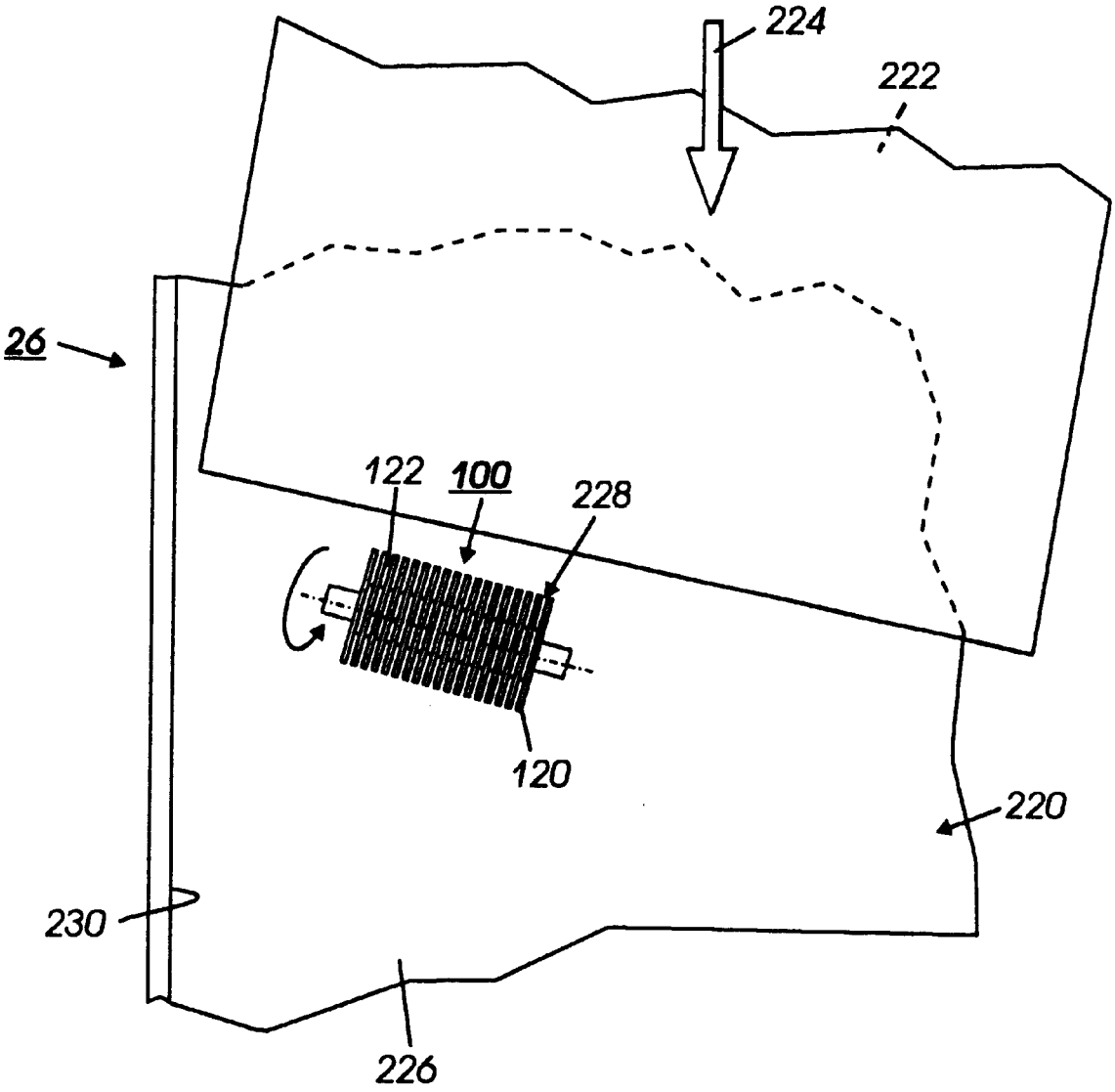
FIG. 2 is a plan view of part of the document handler of the machine of FIG. 1, illustrating in detail one application of a force reducing deskew roll of the present invention.

Referring now to FIGS. 1 and 2, FIG. 2 is a plan view of part of the document handler 26 of the machine 8 of FIG. 1, illustrating in detail the deflectable ribs 120 and grooves 122 of a driving force reducing sheet deskew roll 100 of the present invention. The document sheet handler 26 has a document sheet deskew and registration assembly that includes a sheet transport path 220 and means (rolls 212) for moving a sheet 222 in a process direction 224 along the sheet transport path 220 to a registration position (not shown) on the platen 28. As shown in FIG. 2, the deskew and registration assembly of the handler 26 comprises a sheet supporting member 226 along the transport path 220. The sheet support member 226 has a top surface as shown that forms a section of the sheet transport path 220, and includes a deskew opening 228 formed through the top surface. The deskew and registration assembly of the handler 26 also includes a side edge alignment guide member 230 that is mounted to one side of the top surface of the support member 226, and parallel to the process direction, for contacting and aligning a side edge of a sheet being moved over the top surface.

Importantly, the deskew and registration assembly of the handler 26 includes the rotatably drivable, force reducing deskew roll 100 of the present invention. As shown, the deskew roll 100 is mounted to the sheet supporting member 226 through the deskew opening 228, and such that its rotational axis is angularly oriented relative to the process direction and to the side edge alignment guide member 230. As is well known, such an arrangement enables the deskew roll, or cross roll 100, to drive the sheet in a cross direction into the side edge guide member 230. The deskew roll 100 as shown has a compliant layer for contacting and exerting a driving force to a sheet 222 being moved over the support member 226 so as to drive the sheet cross-wise against the side edge alignment guide 230. The layer of the deskew roll 100 includes a series of deflectable and resilient ribs 120, and a series of grooves 122, formed non-axially and preferably circumferentially therein as shown, for enabling the ribs 120 to deflect temporarily into a form shown as 120' (FIG. 5) once the sheet contacts the side edge alignment guide member 230, thereby reducing the drive force and hence damage to the sheet 222 as well as to a surface of the side edge alignment guide member 230.

Figure 3:
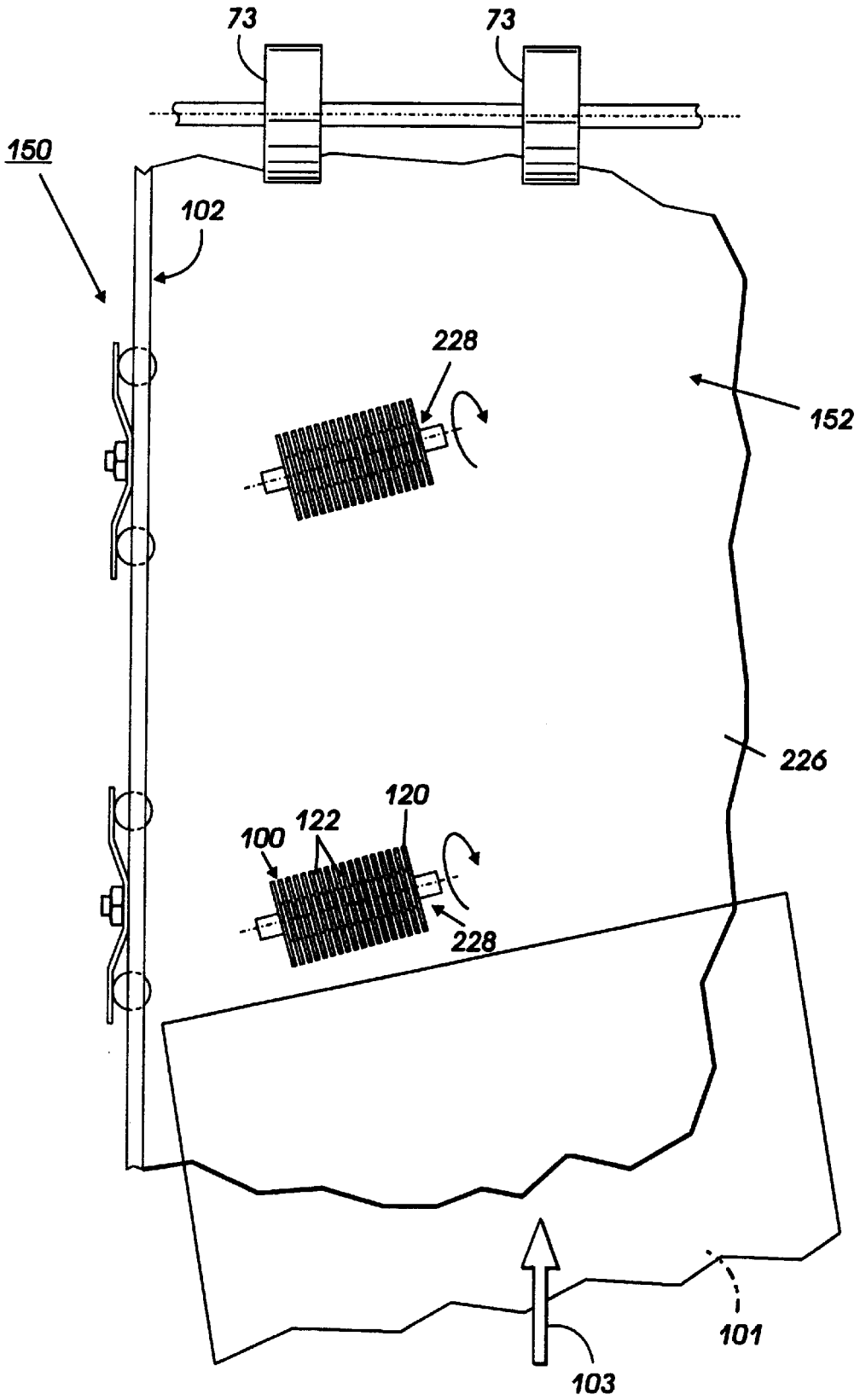
FIG. 3 is a plan view of part of the copy sheet handling system of the machine of FIG. 1, showing a copy sheet registration assembly including a pair of the driving force reducing sheet deskew rolls in another application in accordance with the present invention.
Figure 5:
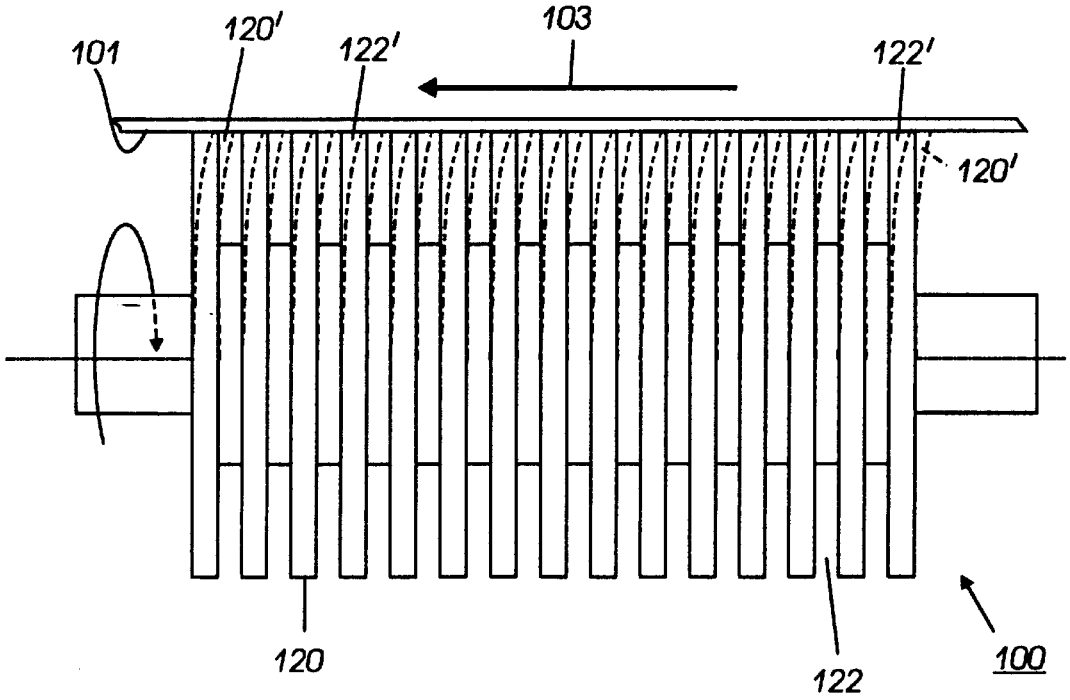
FIG. 5 is a schematic illustration of one of the force reducing rolls of FIG. 3 with ribs deflected under a sheet in accordance with the present invention.

Referring now to FIGS. 1 3 and 5, FIG. 3 is a plan view of part of the copy sheet handling system of the machine of FIG. 1, showing a copy sheet registration assembly 150 including a pair of the driving force reducing sheet deskew rolls 100 of the present invention. The registration assembly 150 includes a sheet transport path 152 and means (rolls 71) for moving a sheet 101 in a process direction 103 along the sheet transport path 152 to a registration position downstream of the deskew rolls 100. As shown in FIG. 3, the deskew and registration assembly 150 comprises a sheet supporting member 226 along the transport path 152. The sheet support member 226 has a top surface as shown that forms a section of the sheet transport path 152, and includes deskew openings 228 that are formed through the top surface. The deskew and registration assembly 150 also includes a side edge alignment guide member 102 that is mounted to one side of the top surface of the support member 226, and parallel to the process direction 103, for contacting and aligning a side edge of a sheet being moved over the top surface.

Importantly, the deskew and registration assembly 150 includes a pair of the rotatably drivable, force reducing deskew roll 100 of the present invention. As shown, each deskew roll 100 is mounted to the sheet supporting member 226 through a deskew opening 228, and such that its rotational axis is angularly oriented relative to the process direction and to the side edge alignment guide member 102.

As is well known, such an arrangement enables the deskew rolls, or cross rolls, to drive the sheet in a cross direction into the side edge guide member 102. The deskew roll 100 as shown has a compliant layer for contacting and exerting a driving force to a sheet 101 being moved over the support member 226 so as to drive the sheet cross-wise against the side edge alignment guide member 102. The layer of the deskew roll 100 includes a series of deflectable and resilient ribs 120, and a series of grooves 122, formed non-axially and preferably circumferentially therein as shown, for enabling the ribs 120 to deflect temporarily into a form shown as 120', and the grooves into shapes 122' (FIG. 5), once the sheet contacts the side edge alignment guide member 102, thereby reducing the drive force and hence damage to the sheet 101 as well as to a surface of the side edge alignment guide member 102.

Transport and registration of copy sheets is accomplished by deskew rolls 100 arranged for urging the copy sheet material against the lateral registration edge guide member 102 while simultaneously advancing the copy sheet along a predetermined path defined by the sheet support member 226. The sheet support member 226 and registration edge guide member 102 are typically integral to the machine, forming a portion of the copy sheet feeding assembly of the entire copy substrate handling system.

In operation, a copy sheet, generally identified by reference numeral 101, is delivered to the sheet support member 226 along a process direction of travel indicated by arrow 103. As depicted, the copy sheet 101 may arrive at the sheet support member 226 having a side edge which is angularly offset or skewed from the defined process direction of travel 103 and/or not in alignment with the registration edge guide member 102. Proper alignment or so-called registration of the copy sheet 101 is accomplished through the use of an active registration device, such as, for example, a cross roll device, as shown, wherein rolls 100 forming a drive nip (FIG. 1) through which the copy sheet material passes. Transport of the copy sheet material is accomplished by a drive means, such as a motor (not shown) suitably connected to one of the rolls 100 for inducing rotational movement thereof which, in turn, induces transport movement of the copy sheet passing therebetween.

As pointed out above, the rolls 100 are situated at an angle relative to each other and relative to the process direction of travel 103 for urging the copy sheet 101 passing therethrough in a lateral direction toward the registration edge guide member 102. An appropriate limited sideways or lateral vector force component is exerted against the copy sheet 101 by the frictional forces of the angularly off-set deskew rolls 100. The lateral vector force component generated by deskew rolls 100 continuously urges the copy sheet 101 passing therethrough toward the registration edge guide member 102 until the edge of the copy sheet 101 is fully abutting the registration edge guide member 102. At such point the deflectable, compliant ribs 120, deflect into the shapes 120', and the grooves into shapes 122' (FIG. 5) in reaction to resistance from sheet contact against the guide member 102, thus reducing the driving force on the sheet, and hence damage to the sheet.

As shown, the registration edge guide member 102 includes a generally smooth inboard surface for providing a low resistance, low friction sidewall against which one edge of each copy sheet 101 is contacted as it is being advanced through rolls 100 for deskewing and side registering. Thus, each copy sheet 101 is accurately side-registered just prior to delivery to the image transfer station DD. All deskewing is accomplished on the sheet support member 226 such that additional transport rolls, as for example rolls 73, need only provide linear transport of the copy sheet 101.

Figure 4:
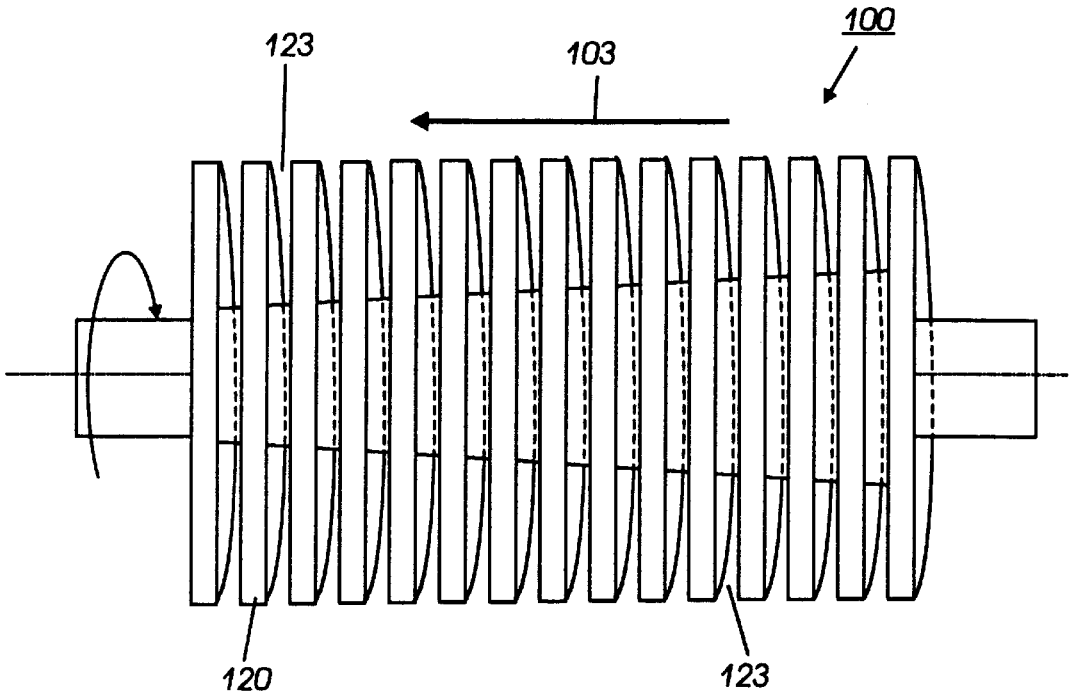
FIG. 4 is a schematic of a second embodiment of the force reducing deskew roll of the present invention including grooves having asymmetric depths.

Referring now to FIG. 4, a second embodiment of the force reducing deskew roll 100 is illustrated, and includes deflectable ribs 120 varying depth or asymmetrical depth grooves 123, with the depths of the grooves increasing from one end to the other of the roll 100. Such a specific pattern is preferred in applications where it is desirable to reduce the driving force on the sheet in one area, for example on an area of the sheet closer to the side edge guide member, while maintaining a sufficient and greater driving force on areas of the sheet further away from the guide member. The deskew rolls 100 of FIGS. 1, 2, 3 and 5 thus can be of a first embodiment as shown therein, or they can be of the second embodiment of FIG. 4.

To recapitulate, the present invention provides a sheet deskew and registration assembly including a force reducing deskew roll. The deskew roll has non-axial, preferably circumferential ring grooves cut into it in a specific pattern, which may be symmetric or asymmetric in depth, forming deflectable ribs, and so as to result in reduced sheet driving forces, particularly in a cross-direction toward a registration side guide. In operation, once the sheet being driven by the deflectable ribs contacts the side guide, the driving force is reduced by the deflectable nature of the rib and groove design or pattern of the deskew roll. The specific pattern of deflectable ribs and ring grooves on the deskew roll operate advantageously to reduce wear and damage to document and copy sheets, as well as, wear and tear on the registration side guide and deskew roll itself. To emphasize, the deskew roll of the present invention reduces wear and damage to sheets being driven and deskewed by reducing lateral drive forces on the sheet once the sheet starts riding against the registration side guide. The roll also adds to customer satisfaction by reducing sheet jams normally resulting from damaged sheets.

It is, therefore, evident that there has been provided, in accordance with the present invention, a sheet deskew and registration assembly including a force reducing deskew roll that fully satisfy the aims and advantages herein before set forth. While this invention has been described in conjunction with a preferred embodiment and method of use, it is evident that many alternatives, modifications, and variations will be apparent to those skilled in the art. Accordingly, it is intended to embrace all such alternatives, modifications and variations as fall within the spirit and broad scope of the appended claims.

I claim:

1. In a sheet handling process machine including a sheet transport path and means for moving a sheet in a process direction along the sheet transport path, a sheet deskew assembly comprising:

(a) a sheet supporting member having a top surface forming a section of the sheet transport path, and a deskew opening through said top surface;

(b) a side edge alignment guide member mounted to one side of said top surface for contacting and aligning a side edge of a sheet being moved over said top surface; and (c) a rotatably drivable deskew roll mounted to said sheet supporting member and through said deskew opening, said deskew roll having a top layer for contacting and exerting a driving force to a sheet being moved over said top surface so as to drive the sheet against said side edge alignment guide member, said top layer of said deskew roll including a series of deflectable and resilient ribs formed therein to be deflected for reducing a driving force on the sheet, in reaction to the sheet contacting said side edge alignment guide member, thereby reducing damage to a surface of said side edge alignment guide member, and to the sheet, and said top layer including a series of grooves wherein grooves of said series of grooves alternate with ribs of said series of ribs, and wherein grooves of said series of grooves have varying and asymmetrical depths one to another.

2. The sheet deskew assembly of claim 1, wherein said side edge alignment guide member is mounted to one side of said top surface, and parallel to the process direction of sheet movement over said top surface.

3. The sheet deskew assembly of claim 1, wherein said deskew roll is mounted angularly relative to the process direction of sheet movement over said top surface.

4. In an electrostatographic reproduction machine for producing copies of original documents, an automatic document handling apparatus comprising:

(a) a frame for mounting to the machine;

(b) a document tray mounted to said frame for holding a set of document sheets;

(c) means defining a document sheet transport path from said document tray;

(d) means for automatically moving a document sheet from said document tray along said sheet transport path into and through a registered position over a platen of the machine; and (e) a document sheet deskew assembly located along said sheet transport path, said deskew assembly including a sheet edge alignment guide member mounted to one side of and parallel to said sheet transport path, and a deskew roll for driving a sheet, moving along said transport path, angularly into alignment contact with said sheet edge alignment guide member, said deskew roll having deflectable and resilient surface ribs to be deflected for reducing a driving force on a sheet being driven, in reaction to such sheet contacting said sheet edge alignment guide member, thereby reducing damage to a surface of said sheet alignment guide member and to the sheet, and said deskew roll including a series of grooves wherein grooves of said series of grooves alternate with ribs of said series of deflectable and resilient ribs, and wherein grooves of said series of grooves have varying and asymmetrical depths one to another.

5. A sheet registration and deskew assembly comprising:

(a) frame defining a sheet transport path;

(b) a registration edge guide member mounted to a side of said sheet transport path;

(c) sheet feeding means mounted to said frame for moving a sheet against said registration edge guide member; and (d) a force reducing deskew roll mounted along said sheet transport path and having a compliant layer including deflectable ribs, and alternating grooves having varying and asymmetrical depths one to another formed therein for enabling said deflectable ribs to deflect, once the sheet is in resisting contact against said registration edge guide member, thus reducing a driving force on the sheet, and hence preventing damage to the sheet as well as excessive wear on the registration edge guide member.

6. An apparatus for deskewing and registering a sheet material moving along a process direction of travel, comprising:

(a) a registration edge guide member defining a surface substantially parallel to the process direction of travel; and (b) at least one ribbed compliant deskew roll for driving the sheet material laterally relative to the process direction of travel so as to urge the sheet material against the registration edge guide member thus providing proper alignment and registration of the sheet material, said ribbed deskew roll including a series of deflectable ribs and alternating grooves between adjacent ribs, said alternating grooves having varying and asymmetrical depths one to another, and each rib of said series of ribs being deflectable once a sheet being driven thereby is in resisting contact against the registration edge guide member, thus reducing a driving force of the deskew roll on such sheet, and preventing wear and damage to the sheet, as well as excessive wear and damage to said registration edge guide member.

* * * * *